US006694653B2

(12) United States Patent
Bradfield et al.

(10) Patent No.: US 6,694,653 B2
(45) Date of Patent: Feb. 24, 2004

(54) PACKAGING/DISPLAY OF PRODUCTS

(75) Inventors: Iain Bradfield, Staffordshire (GB); Simon James Skillings, Staffordshire (GB); Paul Steabben Hepworth, Surrey (GB)

(73) Assignee: Turner Intellectual Property Limited, Staffordshire (GB)

( * ) Notice: Subject to any disclaimer, the term of this patent is extended or adjusted under 35 U.S.C. 154(b) by 76 days.

(21) Appl. No.: 09/913,208

(22) PCT Filed: Dec. 8, 2000

(86) PCT No.: PCT/GB00/04688

§ 371 (c)(1),
(2), (4) Date: Dec. 3, 2001

(87) PCT Pub. No.: WO01/43101

PCT Pub. Date: Jun. 14, 2001

(65) Prior Publication Data

US 2002/0134699 A1 Sep. 26, 2002

(30) Foreign Application Priority Data

Dec. 9, 1999 (GB) ..... 9928987

(51) Int. Cl.[7] ..... G09F 3/00
(52) U.S. Cl. ..... 40/642.01; 40/661.09
(58) Field of Search ..... 40/299.01, 661.09, 40/642.01, 631; 283/107

(56) References Cited

U.S. PATENT DOCUMENTS

| | | | | | |
|---|---|---|---|---|---|
| 4,718,697 | A | * | 1/1988 | Berardus van Amelsfort | 40/299.01 |
| 4,863,195 | A | * | 9/1989 | Capozzola | 40/636 X |
| 5,312,136 | A | * | 5/1994 | Capozzola | 40/636 X |
| 5,380,046 | A | * | 1/1995 | Stephens | 40/636 X |
| 5,437,172 | A | | 8/1995 | Lamy et al. | |
| 5,756,175 | A | * | 5/1998 | Washburn | 428/78 X |
| 5,867,102 | A | * | 2/1999 | Souder et al. | 283/83 |

FOREIGN PATENT DOCUMENTS

| | | | |
|---|---|---|---|
| EP | 0858061 A | 8/1998 | |
| WO | WO 99/13440 | 3/1999 | G08B/13/14 |

* cited by examiner

*Primary Examiner*—Joanne Silbermann
(74) *Attorney, Agent, or Firm*—Nikolai & Mersereau, P.A.

(57) ABSTRACT

A security label for attachment to an article, the security label including a planar security tag laminated in-between first and second carrier layers, the second layer overlying the planar security tag and having a peripheral marginal portion which projects beyond and extends around the peripheral edge of the security tag, said peripheral marginal portion of the second layer being bonded in face to face contact with said first layer, said first layer having a peripheral marginal portion which projects beyond and extends around the peripheral edge of the second layer, said peripheral marginal portion of the first layer providing a surface for securance to said article.

12 Claims, 7 Drawing Sheets

PACKAGING/DISPLAY OF PRODUCTS

This invention relates to improvements in or relating to, packaging/display of merchandise products, and has particular application with smaller types of DIY products which have previously been packaged on a card, for example blister-packed hangers, displayed on a wire support or rail.

One aspect of the invention relates to a convenient way of providing security tagging of the hanger, and another aspect of the invention, which can be employed independently of the security tagging aspect, is an anti-theft mechanism for resisting/hindering removal of the product from its hanger whilst being displayed on sale.

According to one aspect of the present invention there is provided a security label for attachment to an article, the security label including a planar security tag laminated inbetween first and second carrier layers, the second layer overlying the planar security tag and having a peripheral marginal portion which projects beyond and extends around the peripheral edge of the security tag, said peripheral marginal portion of the second layer being bonded in face to face contact with said first layer, said first layer having a peripheral marginal portion which projects beyond and extends around the peripheral edge of the second layer, said peripheral marginal portion of the first layer providing a surface for securance to said article.

Figure 1:
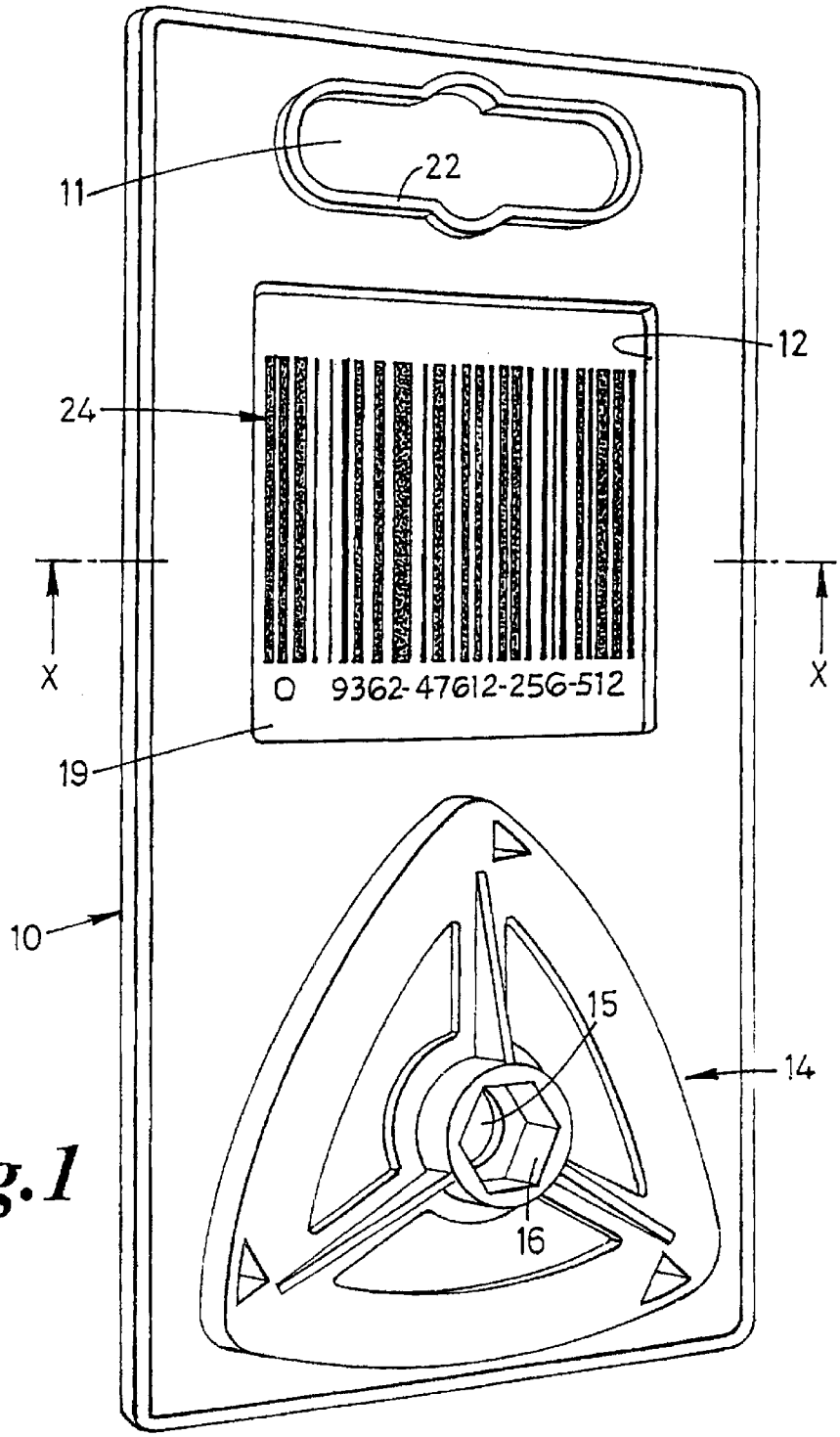
Figure 1A:
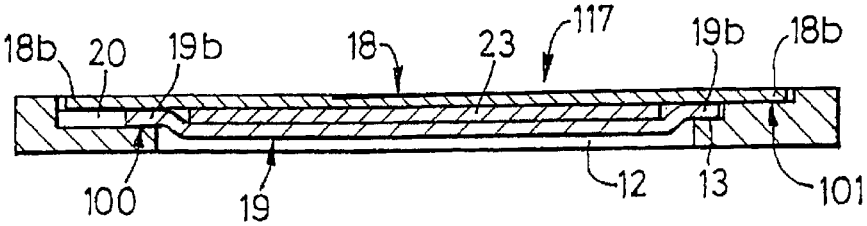
Figure 2:
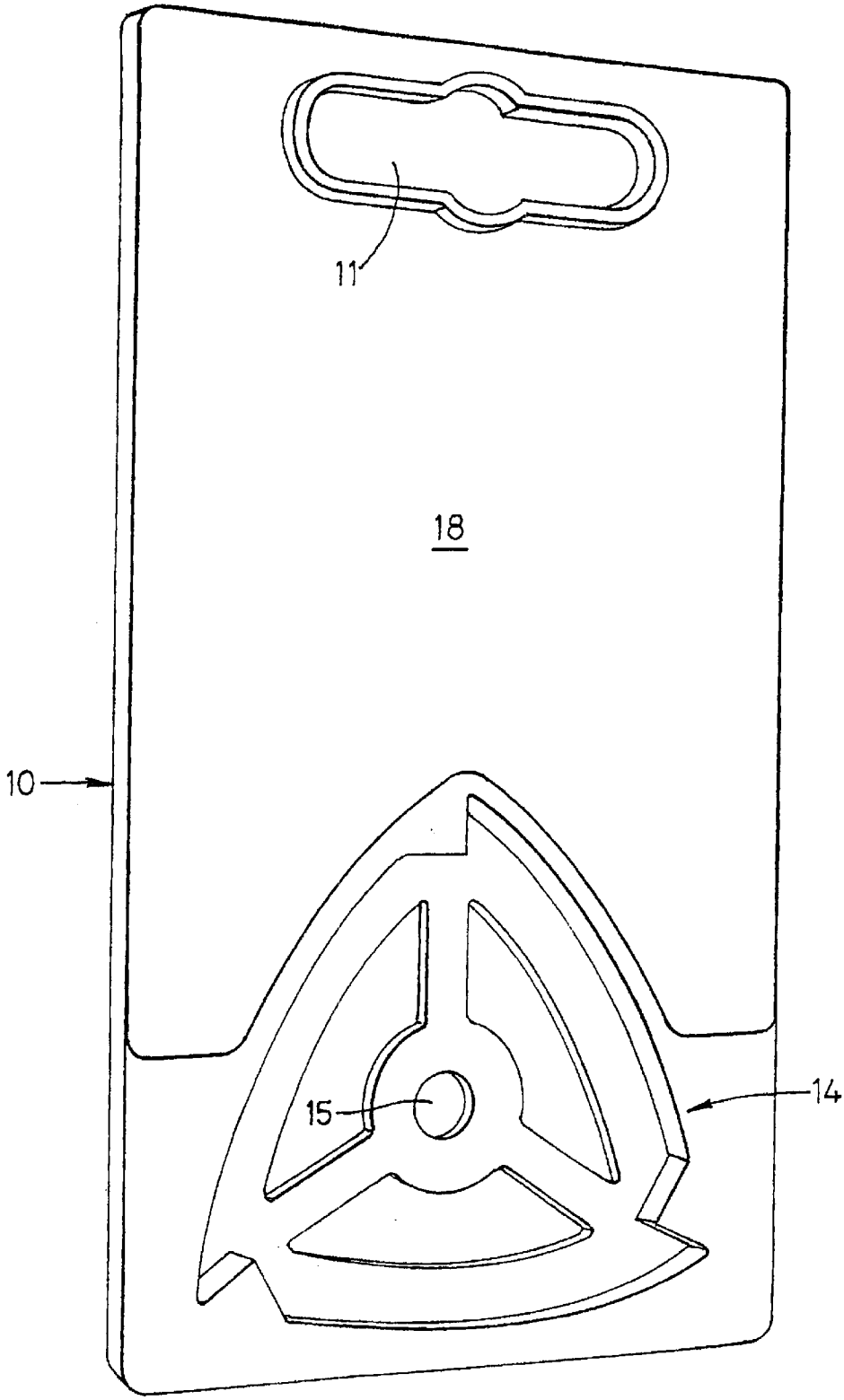
Figure 3:
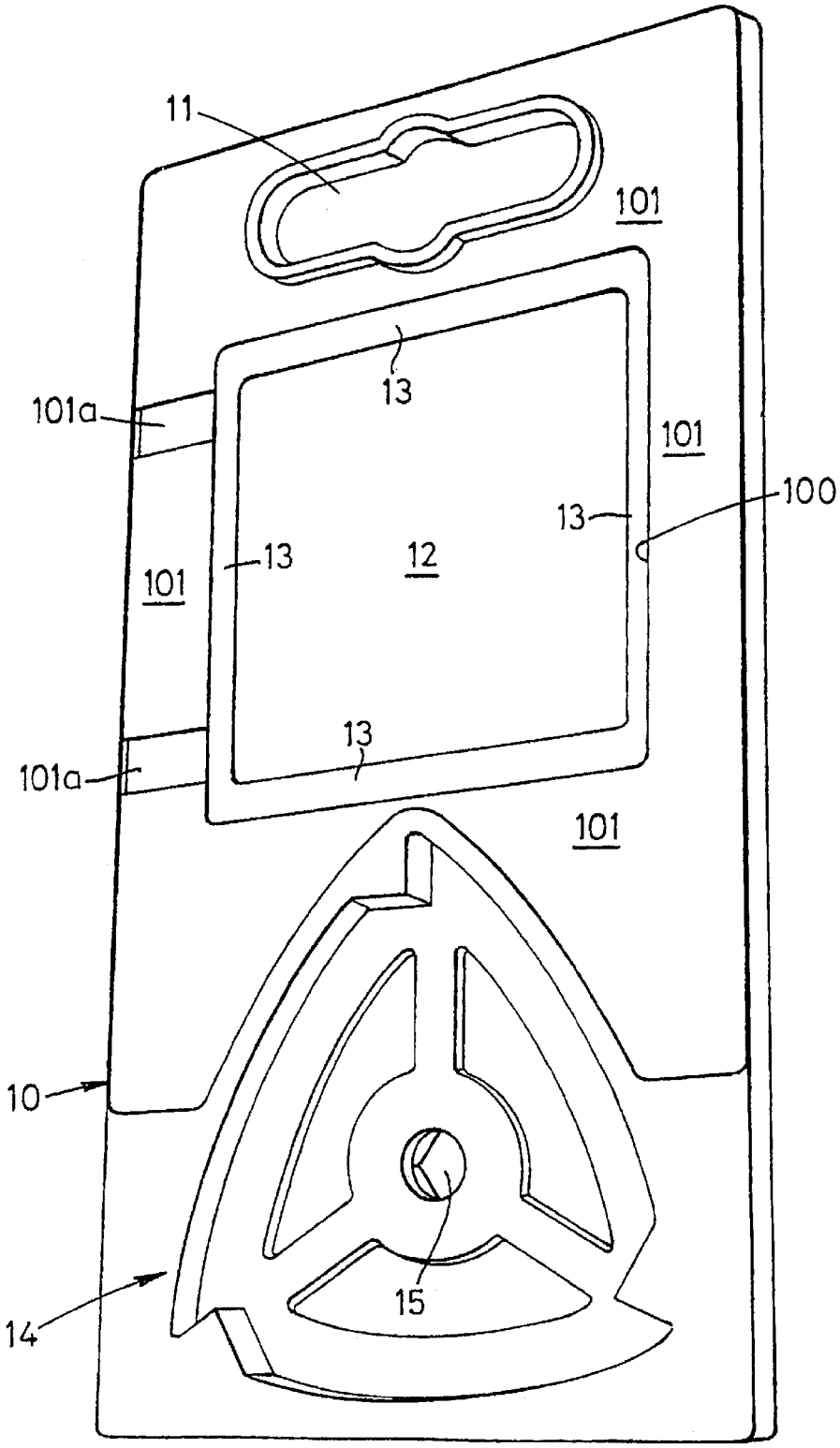
Figure 4:
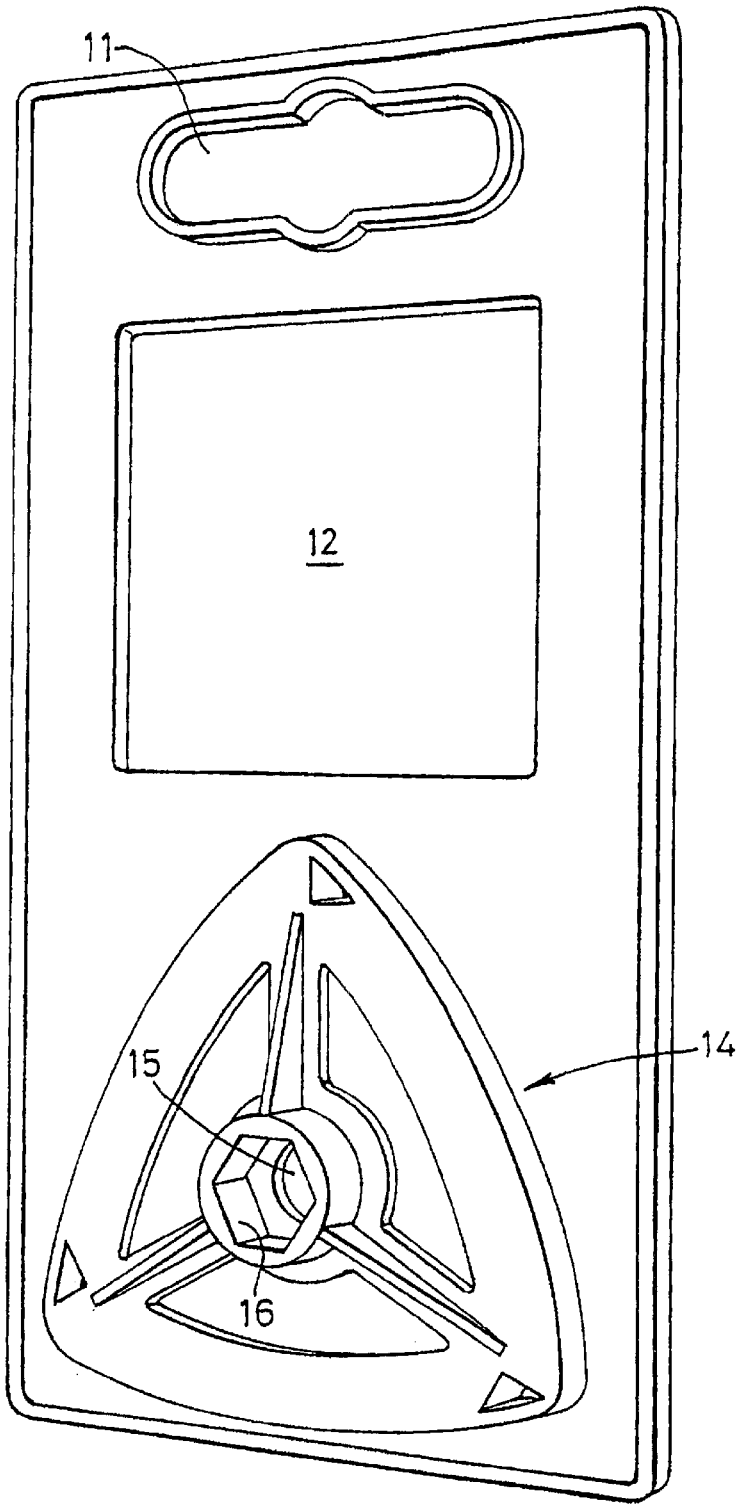
Figure 5A:
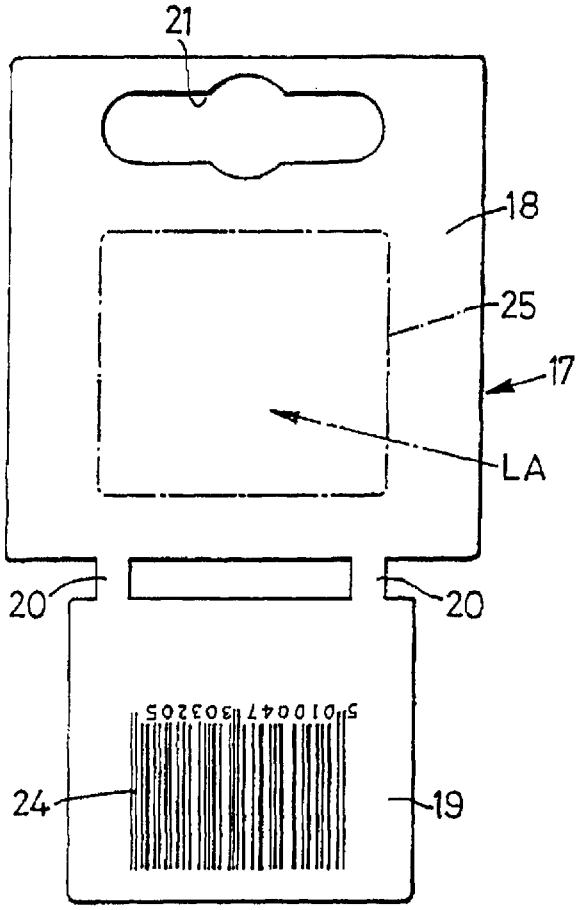
Figure 5B:
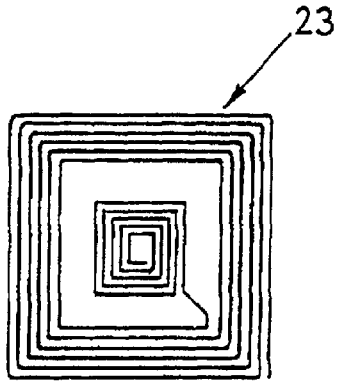

The invention will now be described, by way of example, with reference to the accompanying drawings, in which:

FIG. 1 is a rear perspective view of an embodiment according to the present invention;

FIG. 1*a* is a section along line X—X in FIG. 1;

FIG. 2 is a front perspective view of the embodiment shown in FIG. 1;

FIGS. 3 and 4 are enlarged front and rear perspective views of the hanger shown in FIGS. 1 and 2, FIG. 5*a* shows a label blank of the embodiment of FIGS. 1 and 2, FIG. 5*b* shows an RF tag to be incorporated with the label blank of FIG. 5*a;*

Figure 5C:
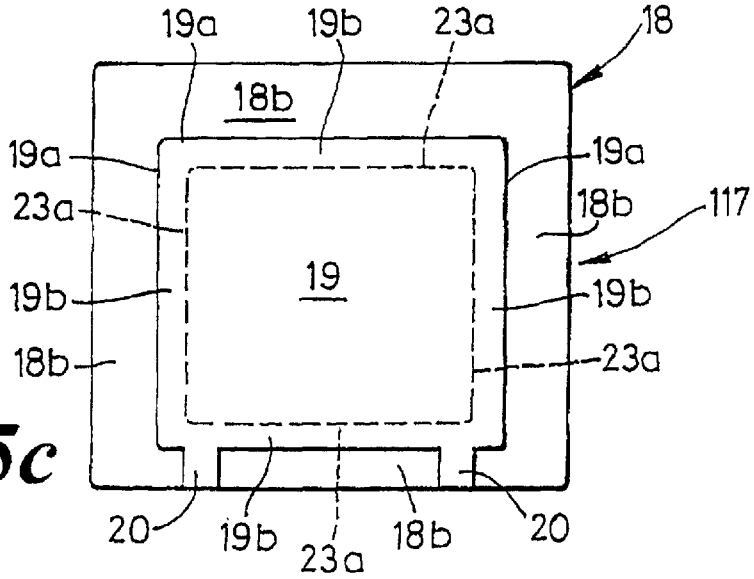
Figure 6:
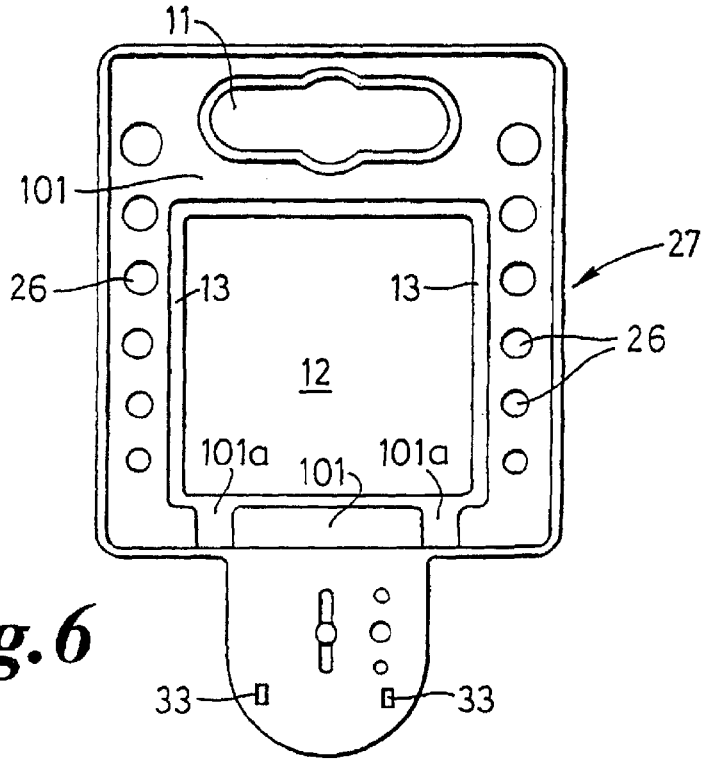
Figure 7:
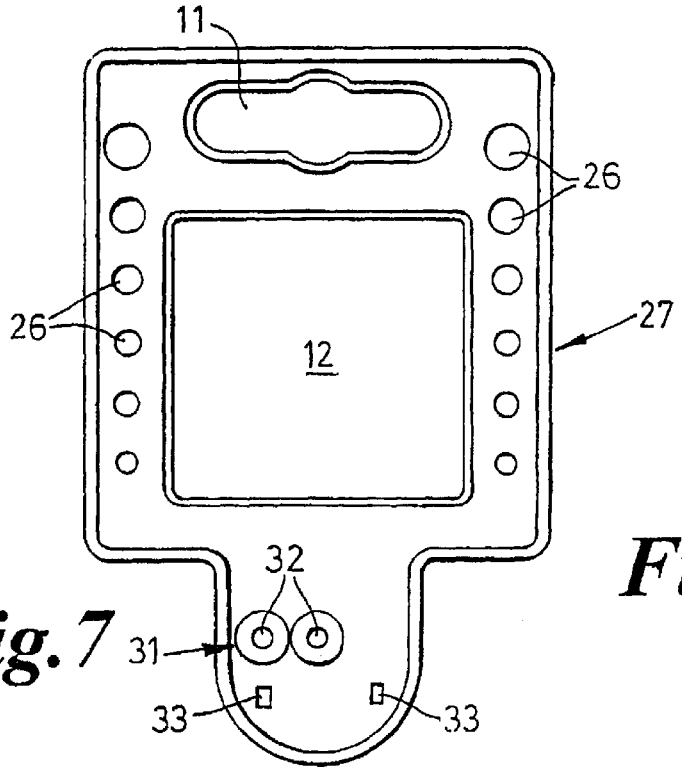
Figure 8:
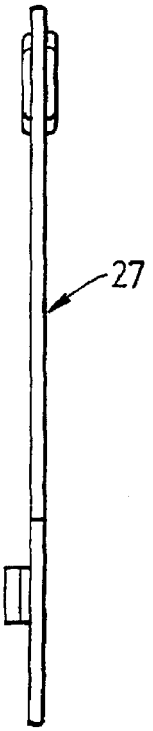
Figure 9:
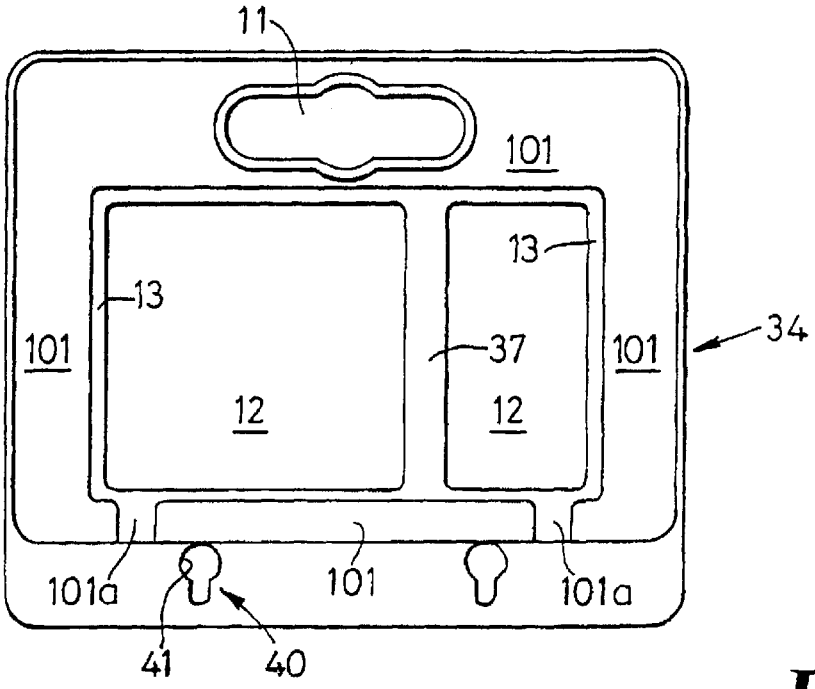
Figure 10:
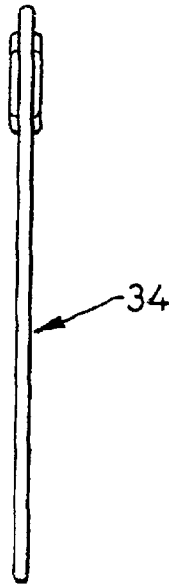
Figure 11:
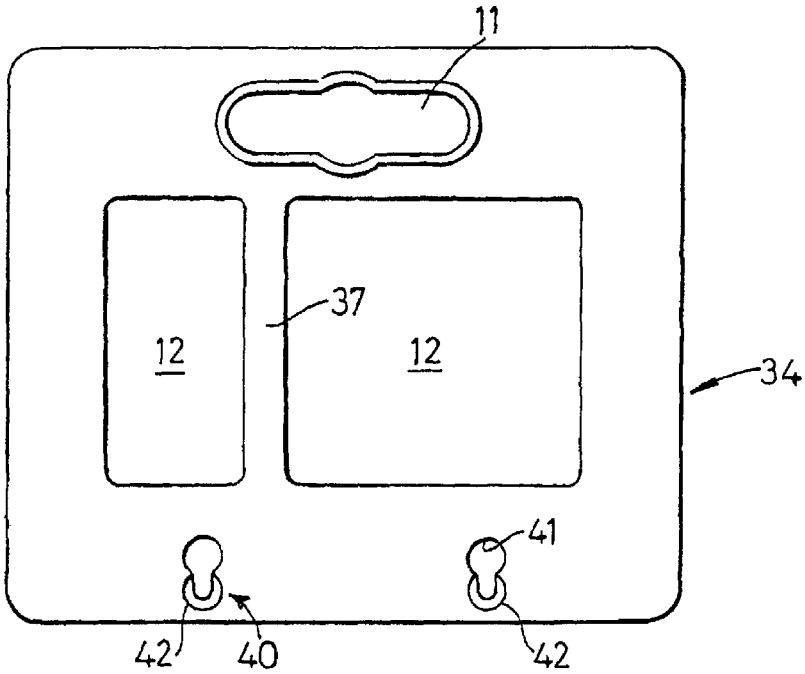

FIG. 5*c* is a rear view of a label assembled from the blank and tag of FIGS. 5*a* and 5*b* respectively;

FIGS. 6 to 8 are respectively a front view, a rear view and a central part-sectional view of a different form of hanger according to the present invention; and FIGS. 9 to 11 are respectively a front view, a side view and a rear view of a further form of hanger according to the present invention.

As will be described hereinafter, this invention relates to improvements in or relating to packaging/display of products, and although the invention will be described in relation to, and has particular application with, smaller types of DIY products, the invention is not restricted solely to the packaging/display of such products, but can find more general application. Moreover although, as will be described, various inventive aspects can conveniently be utilised together, they can alternatively be used independently of one another.

Conventionally small DIY products have been blister-packed onto a rectangular hanger usually formed from card which can have information on both sides thereof, there being adjacent the upper edge of the hanger a slot so that the hanger can be suspended from an elongated metal rod or rail projecting from a display board or the like in a store.

Although with the packaging/display means of the invention, a card having the described slot therethrough could still be used, the packaging/display means of the invention shown in FIGS. 1 to 5 comprises a hanger 10, which, in the embodiment shown in these Figures, is rectangular and is moulded from a plastics material such as high impact polystyrene. Adjacent its upper narrower edge, an elongated slot 11 is provided through the plastics hanger.

Below the slot 11, and disposed centrally between the longer sides of the hanger 10 is an open bottomed recess which defines a square window or opening 12 through the hanger.

Below the opening 12 there is provided a releasable attachment means 14 which is configured to attach a specific form of merchandise product to said hanger, thereby to act as an anti-theft mechanism in preventing, or at least resisting/hindering, removal of the product from its hanger whilst the hanger is hung in a store. Particularly the attachment means may comprise at least one screw, which will prevent opportunist theft of the displayed product from its hanger in a store, in requiring someone removing the product having an implement, such as a screwdriver or the like and being in view for some time whilst removing the fixing screw(s). Although, as will be described, an attachment means 14 of a hanger 10 can be common for co-operation with several different merchandise products, in many cases the attachment means 14 is particular to a single merchandise product. In FIGS. 1 to 4, attachment means is in the form of a bolt (not shown) having a hexagonal head. The hanger 10 is therefore provided with a hexagnonal socket 16 at the rear of the hanger for receiving the hexagnonal head of the bolt and a through bore 15 to enable the shank of the bolt to pass therethrough to the front of the hanger. A nut or cap is provided for screwing on the end of the shank of the bolt at the front of the hanger, thereby to engage against the product and secure it to the front of the hanger.

FIG. 5*a* shows a label blank 17 formed of a square or rectangular front carrier layer or part 18 and a smaller square or rectangular rear carrier layer or part 19, the two parts being preferably foldably connected together at a side of the front part 18 by a pair of integral tabs 20 extending from the rear part 19. The blank 17 is preferably formed from a plastics film suitable for printing or a light paper/card laminated with a plastics film.

As shown, adjacent its edge remote from the connection of the tabs 20, the front part 18 is optionally provided therethrough with a slot 21 which is of identical form to the slot 11 but of slightly increased size so as to fit over a rim 22 which extends around the slot 11 of the hanger at both front and rear sides thereof. At the underside of the front part 18, as viewed in FIG. 5*a*, a square or rectangular location area LA can be indicated (for example by suitable printing) for the positioning of a complementarily shaped Radio Frequency (RF) security tag 23 shown in FIG. 5*b*. This can be of conventional form, namely a thin plastics strip with a metal printed circuit arrangement thereon which can activate conventional security detection equipment adjacent an exit door of a store thereby to sound an alarm bell, buzzer or the like to indicate that the security tag has not been removed/activated and that the tagged product is thus being illegally removed. It will be appreciated that planar security tags of types other than RF tags may be used.

Preferably the rear face of the blank 17 (as viewed in FIG. 5*a*) is coated with a suitable adhesive, preferably a pressure sensitive contact adhesive. Assembly of a label 117 (as seen in FIG. 5*c*) is achieved by locating a planar security tag on the location area LA, and then folding the rear part 19 so as to overlie the security tag 23. The tabs 20 guide the folding operation to ensure that the rear part 19 is centrally located above the location area LA.

The relative shape and sizes of the front part 18, rear parts 19 and security tag 23 are chosen such that in the assembled label 117, the rear part 19 projects beyond and around the peripheral edge 23*a* of the tag 23 to define a peripheral marginal portion 19*b* which is bonded in face to face contact with the front part 18.

In addition, the front part 18 projects beyond and around the peripheral edge 19*a* of the rear part 19 to define a peripheral marginal portion 18*b* for attachment to the hanger 10.

Since the new face of the front part 18 carries an adhesive coating, the adhesive is exposed on the marginal peripheral portion 18*b* for bonding with the hanger 10.

As seen in FIG. 5*c*, the tabs 20 extend across the lower portion of the peripheral marginal portion 18*b* and so in the area of tabs 20, the adhesive on the marginal portion 18*b* is covered by tabs 20. Desirably therefore, the area of adhesive masked by the tabs 20 is kept to a minimum in order to maximize the area for bonding to the hanger. This may be achieved by making the tabs of minimum width and providing a minimum number of tabs.

In order to accommodate the label 117 the hanger 10 is provided with an open bottomed recess 100 (FIG. 1*a*, 3).

The recess 100 is surrounded about its periphery by platform 101 formed by a flat surface on the hanger 10. The marginal peripheral portion 18*b* of the label 117 is bonded in face to face contact with platform 101.

The bottom of the recess 100 is open to define a window 12 surrounded by a ledge 13.

As illustrated in FIG. 1*a*, the dimensions of the widow 12 are chosen to be greater than the dimensions of the RF tag 23 so that the tag 23 is located wholly within the window. In addition, the depth of the ledge 13 below the platform 101 corresponds to at least the thickness of the rear part 19. Accordingly, due to the size of the window 12 (which accommodates the combined thickness of the tag 23 and rear part 19) and the depth of ledge 13, the front part 18, when applied to the platform 101 extends across the recess 100 in a substantially flat manner. Similarly, the rear part 19 when viewed through the window 12, extends in a substantially flat manner.

Accordingly, when bonded to the hanger 10, the label 117 visually appears to an observer to be substantially flat and disguises the fact that a RF tag 23 is laminated inbetween the front and rear parts 18, 19.

It is envisaged that the window 12 may be of reduced dimensions such that the ledge 13 overlies a peripheral marginal portion of the RF tag 23. In such a case, in order to maintain the flat appearance of the label 117, the depth of the ledge 13 would be increased to accommodate the combined thickness of the RF tag 23 and rear part 19.

In addition, in order to disguise the presence of tabs 20 and thereby maintain the flat appearance of the front part 18, the platform 101 is provided with recesses 101*a* corresponding in shape, size and depth to the tabs 20.

Conveniently, the outer face of the rear part 19 is printed with desirable indicia, such as a barcode 24 so that when applied to the hanger 10, the barcode 24 is visible through the window 12.

It will be appreciated that with the arrangement described, it is not possible to tamper with the RF security tag 23 from the rear of the hanger through the window 12 given that the rear part 19 is securely held in the recess 100 by virtue of the front part 18 being securely stuck to the platform 101 on the front of the hanger 10. Thus the edges of the rear part 19 cannot be accessed through the window 12 with a view, to gaining access under these to reach the tag 23. Accordingly a secure, effective and aesthetically pleasing, yet practical security arrangement is provided with a conventional type of 'card' packaging, whilst the new arrangement can be hung on a conventional 'euroslot' hanger. If required, it may be possible for the faces of the RF security tag 23 to be coated with a pressure sensitive contact adhesive to improve its face to face bonding with the front and rear parts 18, 19.

It is envisaged that the bottom of recess 100 may be closed (i.e. the opening which defines window 12 is not provided). In such a case, the depth of the recess is chosen to be sufficient to accommodate the combined thickness of the tag 23 and rear part 19. Preferably, the ledge 13 is retained (for accommodating the thickness of the rear part 19 only) with the ledge 13 surrounding a central well of a depth corresponding to the combined thickness of the tag 23 and rear part 19. With such an arrangement, the tag 23 may be accommodated without affecting the smooth flat appearance of the front part 19 when the label 117 is applied to the hanger 10.

If the recess 100 has a closed bottom, it is envisaged that the plastics material for forming the hanger 10 may be transparent to thereby enable the outer face of the rear part 19 to be viewed.

The only difference between the label shown in FIGS. 1 and 2 and that shown in FIG. 5*a* is that the bottom of the front part of the label shown in FIGS. 1 and 2 is shaped to accommodate the arrangement 14, so that here the rear part of the label would not project from the bottom of the front part but from the top thereof, at which it is foldable relative to the front part, with the tabs extending further to bring the rear part, when folded, in register with the rebated opening 12.

The front surface of the front part 18 can be printed with information, as required, but if further or more detailed instructions are needed with the packaging, a fold-out label can be secured to the front of the part 18. The label 117 has the barcode printed on its rear part 19 and, as described, the window 12 frames the barcode at the rear of the hanger.

In the embodiment shown in FIGS. 1 and 2, a series of differently sized circular holes 26 can be provided through the hanger at the sides of the opening 12, so that these remain visible at the rear of the package. These holes 26 can be provided with the packaging for certain DIY products, so as to function as a drill bit ~and screw size gauge, the holes also serving to reduce material in the pack.

FIGS. 6 to 8 show a further form of hanger, denoted by the numeral 27, which is adapted to receive a label 117 in the same manner as the hanger 10. In this regard the hanger 27 has a recess defining a window 12 surrounded by a ledge 13. The platform 101 is provided with recesses 101*a* for receiving tabs 20. In the embodiment shown in FIGS. 6 to 8, the hanger is also provided with drill bit holes of the same or a similar form to the holes 26 for the hanger 10.

The main difference with the hanger 27 is in relation to the attachment arrangement at its lower end for securing a product to the hanger. With the hanger 27, the attachment arrangement, identified by the numeral 31, is such that several different products can all be secured thereto by a screw fixing, possibly in conjunction with some form of fixing cap, strap, tab, nut or the like which can be a separate moulded part, for example, to engage on the screw and be tightened against part of the product so as to hold it firmly on the hanger. For example the hanger 27 shown in FIGS. 6 to 8, along with the label 117 attached thereto can form a point of sale display/security hanger for such DIY products as a silicone sealant finisher, an adhesive spreader set, a tile nibbler, a tile and laminate cutter and a tile lift, all these products merely being attached by a screw fixing at the arrangement 31 with the remainder of the product hanging down from the bottom of the hanger 27. As well as screw fixing holes 32 into which the securing screw would be self tapping, the arrangement 31 also optionally incorporates cable tie threading boles 33 through which a tie can be threaded for securing a merchandise product to the hanger.

A further form of hanger 34 shown in FIGS. 9 to 11. In principle, hanger 34 differs from hanger 10 in that the window 12 is divided by a cross portion 37 of the hanger. The provision of one or more cross portions 37 provides strength to the hanger and enables a relatively large window 12 to be produced. An attachment arrangement 40 is shown at the bottom of the hanger 34, disposed within the confines of the rectangular shape of the hanger itself, rather than being an appendage therefrom. The arrangement 40 incorporates two spaced key hole slots 41 in the rear surface of the hanger, these having respective associated countersunk holes 42 at the lower ends thereof in the front surface of the hanger, this hanger being particularly for attachment of a tile shaper.

In the above described embodiments, the label 117 has been applied to a hanger to which a merchandise product is to be attached. It will be appreciated that the label 117 of the present invention may be applied to other types of product. It will also be appreciated, that the hanger of the present invention is highly environmentally friendly as it uses the minimum quantity of materials necessary, all of which may be recycled and can be reused in various ways, thereby ensuring that there is minimal wastage of raw materials. In addition, by incorporating useful utility features into the hanger during moulding, the user may find the hanger itself a useful tool (such as a drill/screw gauge or ruler) after removal of the merchandise product. This makes the hanger even more environmentally friendly since the hanger is not discarded as waste but is retained for use by the user.

The hanger having a label 117 applied thereto enables consumers to touch and feel the merchandise product; reduces space taken up by the product on the shelf; eliminates unnecessary packaging; reduces the amount of damaged products in store; reduces theft through one or both of the security tagging and the anti-theft mechanism; its design enables the same shelf system to be used; the security tag is both concealed from view and located so as to be tamper proof it enables detailed instructions to be incorporated onto the folded label at the front of the packaging whilst always allowing the barcode to be visible at substantially the same position at the rear of the packaging.

Instead of being of plastics material, the hanger could be of card or any other suitable material. In a further alternative arrangement, the security tag could be moulded into the thickness of the plastics material hanger. The security tag used can be of any type and can also be of any suitable shape or form.

What is claimed is:

1. A security label for attachment to an article, the security label including a planar security tag laminated inbetween first and second carrier layers, the second layer overlying the planar security tag and having a peripheral marginal portion which projects beyond and extends around the peripheral edge of the security tag, said peripheral marginal portion of the second layer being bonded in face to face contact with said first layer, said first layer having a peripheral marginal portion which projects beyond and extends around the peripheral edge of the second layer, said peripheral marginal portion of the first layer providing a surface for securance to said article, said label secured in face to face contact with said article, said article includes a body having a recess surrounded by a platform to which said peripheral marginal portion of the first layer is adhesively bonded, said recess having a peripheral shape and being of sufficient depth to accommodate said second layer and said security tag.

2. A label according to claim 1 wherein opposed faces of the first and second layers are coated with an adhesive such that said peripheral marginal portion of the second layer is bonded in face to face contact with said first layer by said adhesive and such that adhesive is exposed on said peripheral marginal portion of the first layer to enable the label to be adhesively secured to said article.

3. A label according to claim 2 wherein said adhesive is a pressure sensitive adhesive.

4. A label according to claim 2 wherein said first and second layers are foldably connected to one another prior to lamination.

5. The combination according to claim 1 wherein said recess is open bottomed to define a window.

6. The combination according to claim 1 wherein said recess has a closed bottom formed of a transparent material to render visible the outer face of the second layer.

7. The combination according to claims 1 wherein said body is shaped to define a merchandise hanger to which a merchandise product is attached.

8. The combination according to claim 7 wherein said merchandise hanger is of planar form having front and rear faces, said surrounding platform being formed on said front or rear face.

9. The combination according to claims 7 wherein said merchandise product is secured to said body by releasable attachment means.

10. The combination according to claim 9 wherein the releasable attachment means comprises a screw or bolt.

11. The combination according to claims 1 wherein said body is a plastics moulding.

12. A method of applying a planar security tag to an article, the method comprising forming a label according to claim 1 and adhesively bonding said peripheral marginal portion of the first layer to said article.

* * * * *